US009206758B2

(12) United States Patent
Rodriguez-Amaya et al.

(10) Patent No.: US 9,206,758 B2
(45) Date of Patent: Dec. 8, 2015

(54) METHOD FOR OPERATING A FUEL INJECTION SYSTEM OF AN INTERNAL COMBUSTION ENGINE

(75) Inventors: Nestor Rodriguez-Amaya, Stuttgart (DE); Siegfried Ruthardt, Altdorf (DE); Holger Rapp, Ditzingen (DE); Wolfgang Stoecklein, Waiblingen (DE); Bernd Berghaenel, Illingen (DE); Marco Beier, Stuttgart-Feuerbach (DE)

(73) Assignee: ROBERT BOSCH GMBH, Stuttgart (DE)

( * ) Notice: Subject to any disclaimer, the term of this patent is extended or adjusted under 35 U.S.C. 154(b) by 358 days.

(21) Appl. No.: 13/994,415

(22) PCT Filed: Nov. 23, 2011

(86) PCT No.: PCT/EP2011/070784

§ 371 (c)(1),
(2), (4) Date: Aug. 13, 2013

(87) PCT Pub. No.: WO2012/079933

PCT Pub. Date: Jun. 21, 2012

(65) Prior Publication Data

US 2013/0312709 A1 Nov. 28, 2013

(30) Foreign Application Priority Data

Dec. 15, 2010 (DE) ..... 10 2010 063 099

(51) Int. Cl.
*F02D 41/30* (2006.01)
*F02D 41/20* (2006.01)
*F02D 41/14* (2006.01)

(52) U.S. Cl.
CPC ..... *F02D 41/30* (2013.01); *F02D 41/20* (2013.01); *F02D 41/2096* (2013.01);

(Continued)

(58) Field of Classification Search
CPC ..... F02D 41/30; F02D 41/20; F02D 41/2096
USPC ..... 123/472, 478, 490; 701/105
See application file for complete search history.

(56) References Cited

U.S. PATENT DOCUMENTS 4,856,482 A 8/1989 Linder et al.
5,245,501 A 9/1993 Locher et al.

(Continued)

FOREIGN PATENT DOCUMENTS

CN 1977101 A 6/2007
CN 101010503 A 8/2007

(Continued)

OTHER PUBLICATIONS

International Search Report, International Application No. PCT/EP2011/070784, dated Mar. 2, 2012.

*Primary Examiner* — Hai Huynh
(74) *Attorney, Agent, or Firm* — Kenyon & Kenyon LLP

(57) ABSTRACT

A method for operating a fuel injection system of an internal combustion engine is described. The fuel injection system has an injector for metering fuel into a combustion chamber of the internal combustion engine. The injector has an actuator, a control valve and a nozzle needle. In the method, the actuator is supplied a voltage and/or a current during an activation period. The control valve is set into a lifting motion by the actuator. The injector is opened and closed by the nozzle needle, using the lifting motion of the control valve. A further time period is ascertained. The further time period ends at the closing time of the nozzle needle. A function is ascertained, which links the activation period to the further time period. A shortest activation period, for which the nozzle needle opens and produces an injection, is ascertained with the aid of the function. An opening delay period ($d_{o1}$) of the nozzle needle is ascertained as a function of the shortest time period.

13 Claims, 6 Drawing Sheets

(52) U.S. Cl.
CPC ..... *F02D 2041/1429* (2013.01); *F02D 2041/2031* (2013.01); *F02D 2041/2055* (2013.01); *F02D 2041/2058* (2013.01)

(56) References Cited

U.S. PATENT DOCUMENTS

| | | | | |
|---|---|---|---|---|
| 5,892,649 | A | 4/1999 | Kahr et al. | |
| 2011/0251808 | A1* | 10/2011 | Serra et al. | 702/64 |
| 2013/0327301 | A1* | 12/2013 | Brandt | 123/478 |

FOREIGN PATENT DOCUMENTS

| | | | |
|---|---|---|---|
| CN | 102245880 | A | 11/2011 |
| DE | 36 09 599 | | 9/1987 |
| DE | 38 43 138 | | 6/1990 |
| DE | 196 07 073 | | 8/1997 |
| DE | 10 2008 044 144 | | 6/2009 |
| EP | 1 544 446 | | 6/2005 |
| GB | 2310540 | A | 8/1997 |

* cited by examiner

METHOD FOR OPERATING A FUEL INJECTION SYSTEM OF AN INTERNAL COMBUSTION ENGINE

FIELD

The present invention relates to a method for operating a fuel injection system of an internal combustion engine.

BACKGROUND INFORMATION

In conventional injectors for injecting fuel, a control valve is moved by activating an actuator, for example, a magnetic or piezoelectric actuator. The control valve is in hydraulic communication with a nozzle needle, the nozzle needle opening or closing the injector as a function of the state of the control valve.

In addition, an activation starting time and activation ending time of the activation of the actuator may be ascertained. The determination of a closing time of the control valve is described in German Patent Nos. DE 3 609 599 A1 or DE 3 843 138 A1.

SUMMARY

In accordance with an example embodiment of the present invention, the method advantageously allows the fuel quantity injected by the injector to be ascertained accurately by determining an opening delay period of the nozzle needle. The opening delay period begins at an activation starting time, which marks the beginning of the activation of the actuator, and ends at the opening time of the nozzle needle. The opening delay period of the nozzle needle is advantageously ascertained in connection with a minimum activation period, the minimum activation period corresponding to the activation period for the actuator, during which the injector just barely does not open. The minimum activation period is ascertained from a function, which links the activation period to a further time period. This injected fuel quantity determined more accurately in such a manner may, in turn, have an influence on further calculations. All in all, the method contributes towards improving the control or regulation of the internal combustion engine, and accordingly, the method results in fuel being able to be saved and pollutant emissions being able to be further reduced.

In one advantageous specific embodiment of the example method, the further time period is a closing period of the nozzle needle, which begins at a closing time of the control valve. The closing time of the control valve corresponds to a transition of the valve needle into a closing motion. Consequently, the known closing time of the control valve also has an influence on the determination of the opening time of the nozzle needle.

In one advantageous specific embodiment of the example method, the further time period is a closing delay period, which begins at an activation ending time of the activation of the actuator. If, for example, the closing time of the control valve is not available, then this known activation ending time or the known closing delay period may advantageously have an influence on the determination of the opening time of the nozzle needle.

In one advantageous specific embodiment of the method, pairs of values are ascertained from the activation period and the further time period, that is, the closing period or the closing delay period. The function is ascertained from the pairs of values using, for example, linear regression. Thus, the assumption of a linear relationship between the activation period and the further time period simplifies the determination of the function.

Additional features, possible uses and advantages of the present invention are derived from the following description of exemplary embodiments of the present invention, which are illustrated in the figures of the drawing. In this context, all of the described or illustrated features form the subject matter of the present invention, either alone or in any combination, irrespective of their combination in the patent claims or their antecedent references, and also irrespective of their wording and illustration in the description and in the drawing, respectively. In all of the figures, as well as in different specific embodiments, the same reference characters are used for functionally equivalent variables.

In the following, exemplary embodiments of the present invention are explained with reference to the figures.

DETAILED DESCRIPTION OF EXAMPLE EMBODIMENTS

Figure 1:
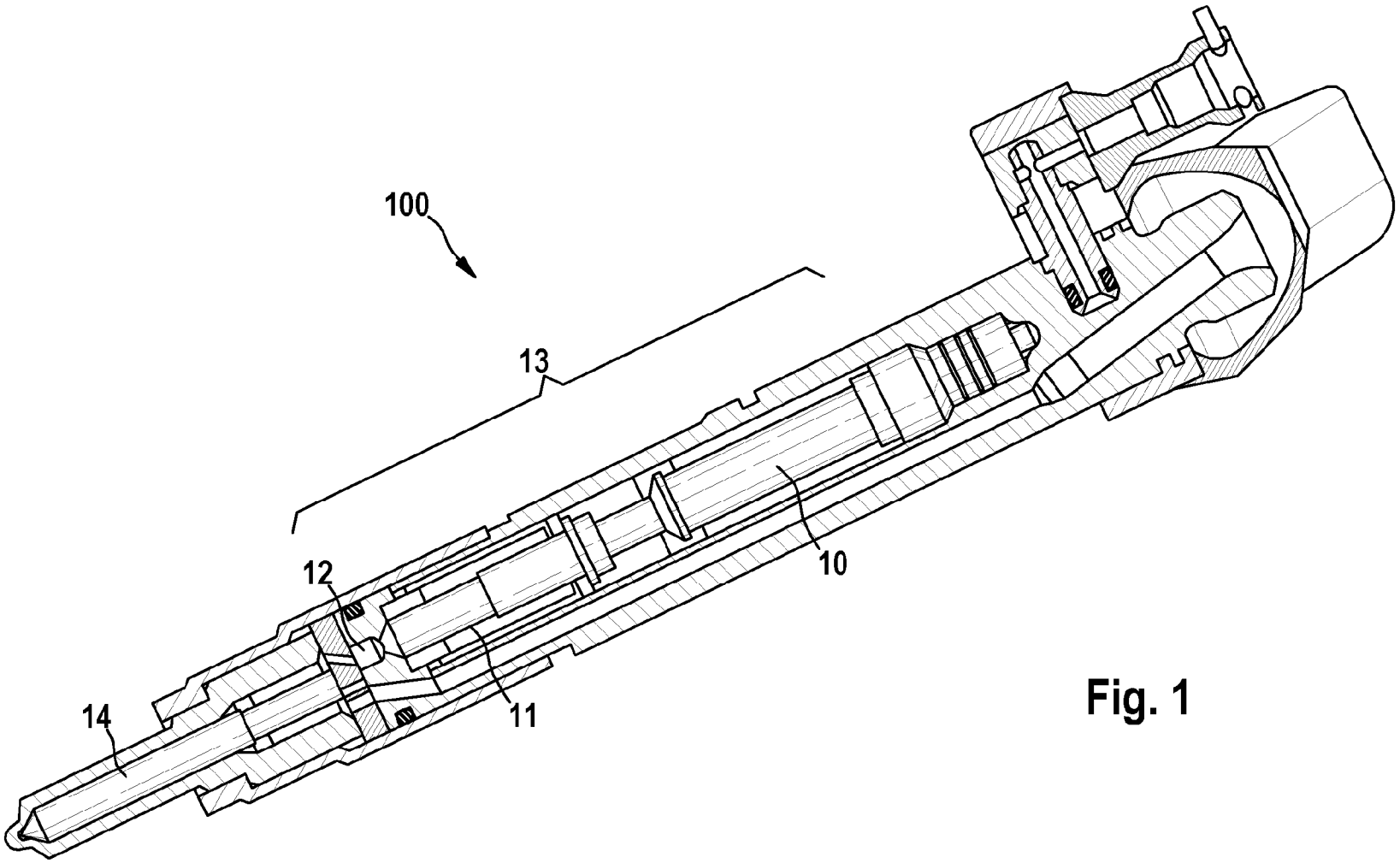
FIG. 1 shows a schematic cross-section of a piezoelectric injector.

The piezoelectric injector 100 shown in FIG. 1 is used for injecting fuel into a combustion chamber of an internal combustion engine not shown. Piezoelectric injector 100 is part of a fuel injection system of the internal combustion engine. For example, this fuel injection system operates according to the so-called common rail method. The feeding of fuel through piezoelectric injector 100 is controlled by a piezoelectric actuator 10, which is activated by a control unit, using an electric voltage. The expansion of piezoelectric actuator 10 in the longitudinal direction, that is, along the longitudinal axis of piezoelectric injector 100, changes as a function of the voltage. Piezoelectric actuator 10 is connected to a control valve 12 via a hydraulic coupler 11. Piezoelectric actuator 10 acts upon control valve 12, using a lifting motion. The motion of a nozzle needle 14 in the longitudinal direction is hydraulically controlled by control valve 12, so that nozzle needle 14 opens or closes piezoelectric injector 100 and consequently meters fuel into the combustion chamber. Piezoelectric injector 100 is opened and closed again by nozzle needle 14, using the lifting motion of control valve 12. Piezoelectric actuator 10, hydraulic coupler 11, as well as control valve 12, are also referred to below as an actuator train 13. As an alternative to piezoelectric actuator 10 in FIG. 1, a magnetic actuator may also be used for imparting a lifting motion to control valve 12.

Figure 2C:
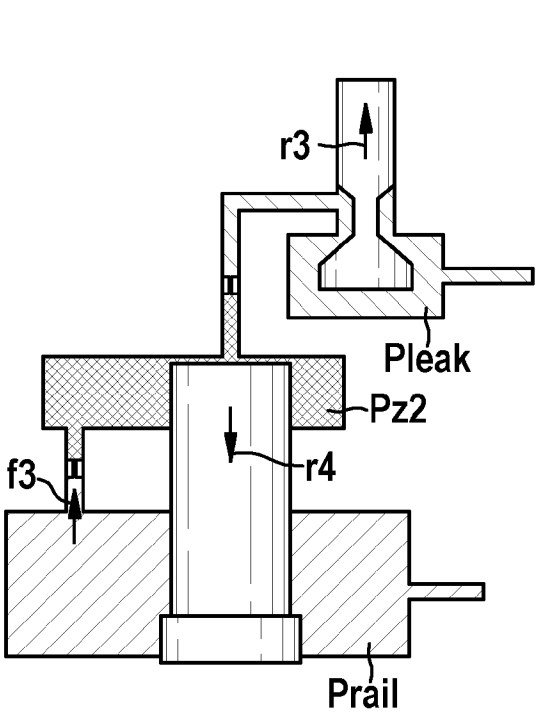
FIG. 2*c* shows the schematically illustrated control valve in a "close" state.
Figure 2B:
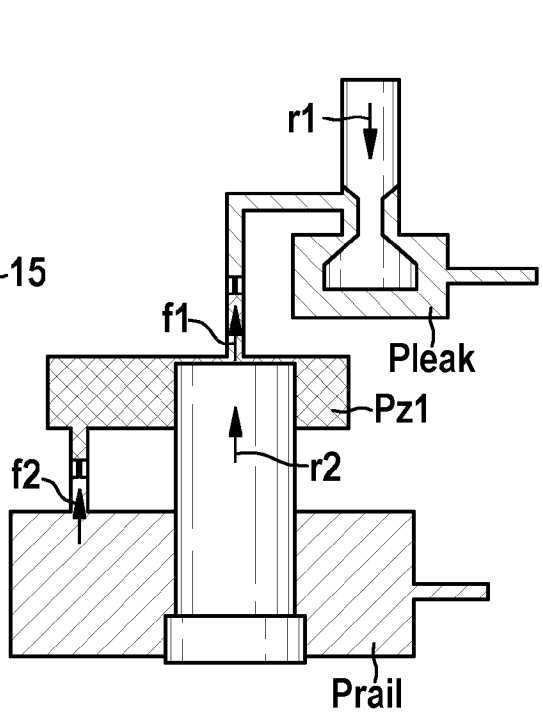
FIG. 2*b* shows the schematically illustrated control valve in an "open" state.
Figure 2A:
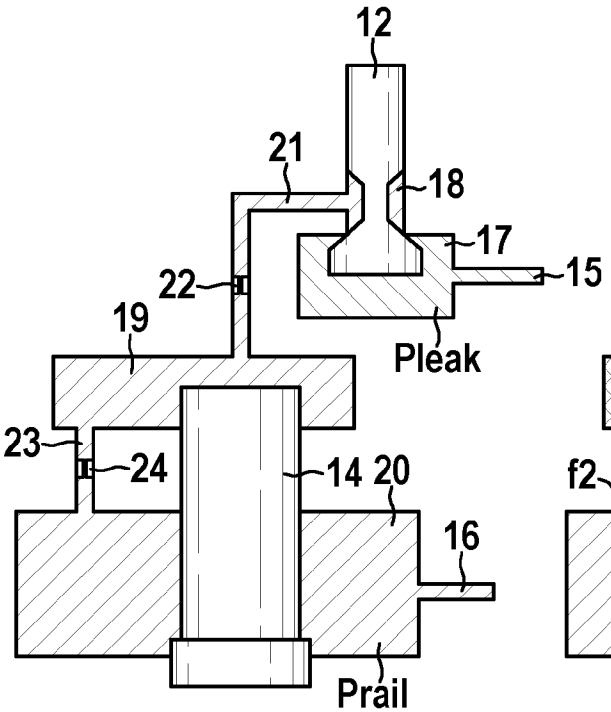
FIG. 2*a* shows a schematically illustrated control valve in a starting position.

FIGS. 2*a*, 2*b* and 2*c* schematically illustrate a hydraulic system, which is filled with fuel. The hydraulic system between control valve 12 and nozzle needle 14 of FIG. 1 is used for controlling the motion of nozzle needle 14 with the aid of control valve 12. However, the hydraulic system according to FIGS. 2*a*, 2*b* and 2*c* is not limited to actuation or operation by a piezoelectric actuator 10 according to FIG. 1, but may alternatively be operated by the above-mentioned magnetic actuator or another type of actuator. In addition, an outlet 15, an inlet 16, a fuel-delivery termination chamber 17, a valve chamber 18, a control chamber 19 and a pressure chamber 20 are shown. Valve chamber 18 is connected to control chamber 19 by a connecting line 21. Connecting line 21 has an outflow pressure-regulating valve 22. Control chamber 19 is connected to pressure chamber 20 via a connecting line 23. Connecting line 23 has an inflow pressure-regulating valve 24. An oil leakage pressure Pleak is present in fuel delivery termination chamber 17 of FIG. 2*a*, and a rail pressure Prail is present in pressure chamber 20.

In FIG. 2*a*, piezoelectric injector 100 is in the starting state, in which control valve 12 is closed. Therefore, the oil leakage pressure Pleak determined by outlet 15 prevails in fuel delivery termination chamber 17. The rail pressure Prail obtained via inlet 16 prevails in the rest of the system.

If piezoelectric actuator 10 is charged, then it expands in the longitudinal direction. Alternatively, appropriate activation of the mentioned magnetic actuator or another type of actuator results in a corresponding action of a force upon control valve 12 and, therefore, in a lifting motion of control valve 12. Control valve 12 is imparted a corresponding lift by actuator train 13 and, therefore, opened in a moving direction r1 in accordance with FIG. 2*b*. In this manner, the pressures inside of the hydraulic system change as follows: opening control valve 12 causes fuel delivery termination chamber 17 and valve chamber 18 to be connected, which means that the pressure in valve chamber 18 decreases from rail pressure Prail to a pressure somewhat above oil leakage pressure Pleak. Accordingly, starting from the higher pressure Prail in control chamber 19, fuel flows out of control chamber 19, through outflow pressure-regulating valve 22, in direction f1, and the pressure in control chamber 19 decreases from a previous rail pressure Prail to an intermediate pressure Pz1. The following applies to intermediate pressure Pz1: Prail>Pz1>Pleak. At the same time, fuel continues to flow through connecting line 23 in direction f2 and influences the pressure in control chamber 19.

Therefore, in control chamber 19, the opening of control valve 12 produces a pressure drop, which causes nozzle needle 14 to move up in moving direction r2. This moving direction r2 of nozzle needle 14 means that piezoelectric injector 100 opens to inject fuel.

In order to close piezoelectric injector 100 and, therefore, end the injection of fuel, then, according to FIG. 2*c*, piezoelectric actuator 10 is discharged, and thus, is reduced in size in the longitudinal direction. Alternatively, appropriate activation of the mentioned magnetic actuator or another type of actuator results in the end of the action of a force upon control valve 12, and thus, in a restoring movement of the same. Accordingly, control valve 12 is imparted a lift by actuator train 13, and it moves in moving direction r3 into a closing position. In this manner, less to no more fuel may flow off through outlet 15. In the same manner, the flow through connecting line 21 decreases. Fuel continues flowing through connecting line 23 in direction f3 and causes nozzle needle 14 to move in moving direction r4 and to close piezoelectric injector 100.

Subsequently, when control valve 12 is closed, a state according to FIG. 2*a* may be produced again.

Figure 3:
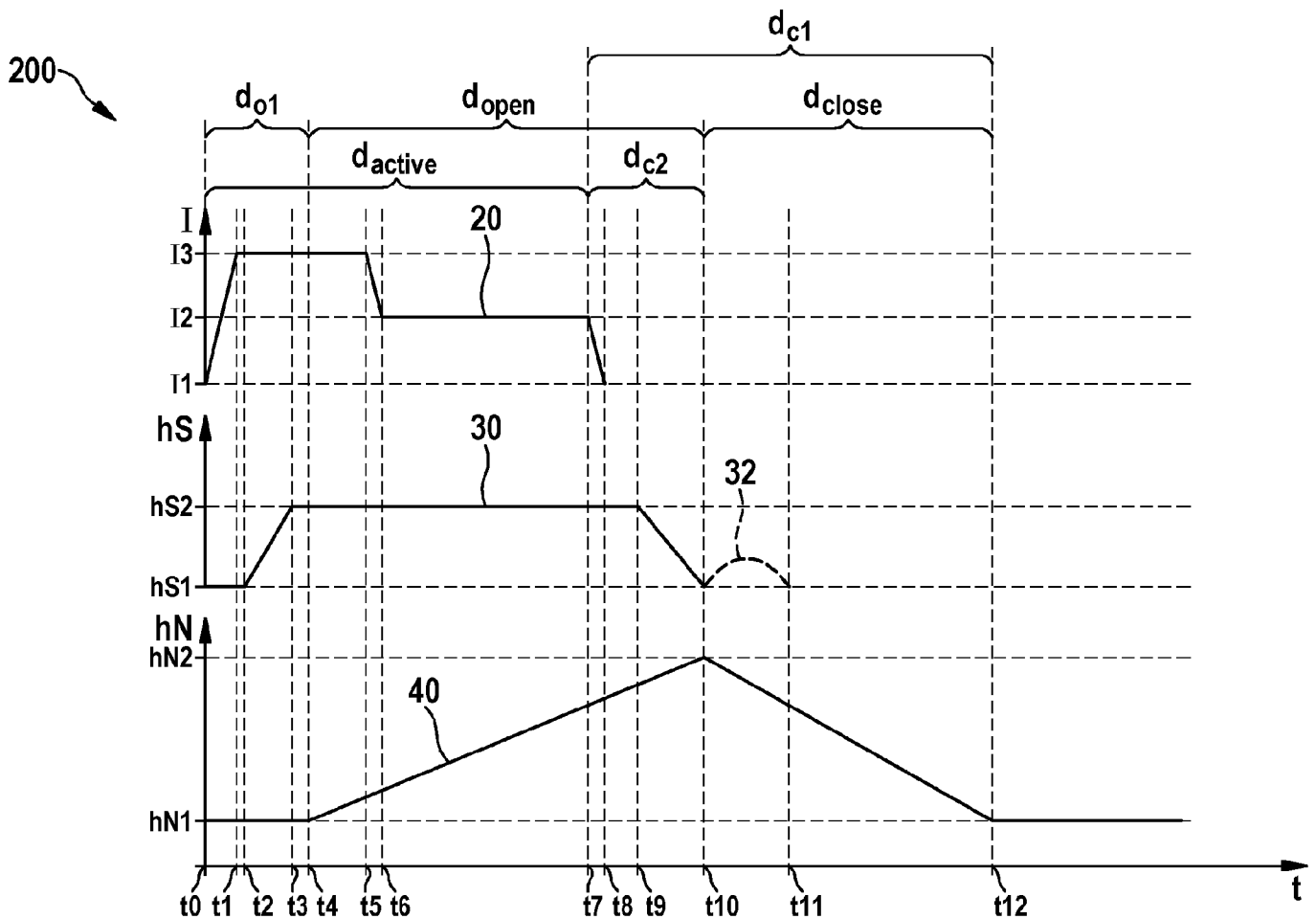
FIG. 3 shows a time-dependency diagram including a schematically illustrated current characteristic of the activation of a magnetic actuator, a schematically illustrated lift characteristic of the control valve, and a schematically illustrated lift characteristic of a nozzle needle.

FIG. 3 shows a time-dependency diagram 200 including a schematically illustrated current characteristic 20 of an activation of a magnetic actuator for opening control valve 12, a schematically illustrated lift characteristic 30 of control valve 12, and a schematically illustrated lift characteristic 40 of nozzle needle 14. Current characteristic 20 is assigned to a current axis I; a first current value I1, a second current value I2 and a third current value I3 being plotted on current axis I. Second current value I2 is greater than first current value I1. Third current value I3 is greater than second current value I2. Lift characteristic 30 of control valve 12 is assigned to a valve lift axis hS; a first valve lift value hS1 and a second valve lift value hS2 being plotted on valve lift axis hS. Second valve lift value hS2 is greater than first valve lift value hS1. Lift characteristic 40 of needle nozzle 14 is assigned a needle lift axis hN; a first needle lift value hN1 and a second needle lift value hN2 being plotted on needle lift axis hN. Second needle lift value hN2 is greater than first needle lift value hN1. Current characteristic 20, lift characteristic 30 of control valve 12 and lift characteristic 40 of nozzle needle 14 each relate to a common time axis t.

At an activation starting time t0, current characteristic 20 is at first current value I1. Between activation starting time t0 and a time t1, current characteristic 20 increases from first current value I1, past second current value I2, to third current value I3. Between time t1 and a time t5, current characteristic 20 is at third current value I3. Between time t5 and a time t6, current characteristic 20 decreases from third current value I3 to second current value I2. Between time t6 and an activation ending time t7, current characteristic 20 remains at second current value I2. Between activation ending time t7 and a time t8, current characteristic 20 decreases from second current value I2 to first current value I1. Activation starting time t0 and activation ending time t7 define an activation period $d_{active}$. For an alternative definition of activation period $d_{active}$, time t1 may be selected, for example, instead of activation starting time t0. In the same manner, for an alternative definition of activation period $d_{active}$, time t8 may be selected instead of activation ending time t7. Consequently, the definition of activation period $d_{active}$ generally corresponds to a time period, during which a certain energy state characterized by current or voltage in an actuator, e.g., the magnetic actuator, is present.

Between activation starting time t0 and an opening time t2 of control valve 12, lift characteristic 30 is at first valve lift value hS1. Between opening time t2 and a time t3, lift characteristic 30 increases from first valve lift value hS1 to second valve lift value hS2. Between time t3 and a time t9, lift characteristic 30 is at second valve lift value hS2. Between time t9 and a closing time t10 of control valve 12, lift characteristic 30 falls from second valve lift value hS2 to first valve lift value hS1. A lift characteristic 32 of control valve 12 is shown between closing time t10 and a time t11; starting from first valve lift value hS1, lift characteristic 32 increasing up to the middle of the interval between closing time t10 and time t11, and then falling back to first valve lift value hS1 by time t11. Lift characteristic 32 corresponds to a bouncing behavior of control valve 12, control valve 12 striking a limit stop at closing time t10, and again at time t11.

Between activation starting time t0 and opening time t2 of control valve 12, lift characteristic 30 is at first valve lift value hS1, which corresponds to the closed state of control valve 12 in FIG. 2*a*. Lift characteristic 30 increases between opening time t2 and time t3, from first valve lift value hS1 to second valve lift value hS2, which corresponds to the opening of control valve 12 in moving direction r1 in FIG. 2*b*. Between time t9 and closing time t10, lift characteristic 30 falls from second valve lift value hS2 to first valve lift value hS1, which corresponds to the closing of control valve 12 in moving direction r3 in FIG. 2*c*. If lift characteristic 30 is at first valve lift value hS1, then control valve 12 is closed. If lift characteristic 30 is at second valve lift value hS2, then control valve 12 is open.

Lift characteristic 40 of nozzle needle 14 is at first needle lift value hN1 between activation starting time t0 and an opening time t4 of nozzle needle 14. Between opening time t4 and closing time t10 of control valve 12, lift characteristic 40 increases from first needle lift value hN1 to second needle lift value hN2; lift characteristic 40 increasing substantially linearly. Between closing time t10 of control valve 12 and a closing time t12 of nozzle needle 14, lift characteristic 40 decreases from second needle lift value hN2 to first needle lift value hN1; lift characteristic 40 decreasing according to a substantially linear function. After closing time t12 of nozzle needle 14, lift characteristic 40 is at first needle lift value hN1. First needle lift value hN1 corresponds to a closed state of injector 100, in which case nozzle needle 14 closes injector 100.

Between opening time t4 and closing time t10, lift characteristic 40 increases from first needle lift value hN1 to second needle lift value hN2, which corresponds to the opening of nozzle needle 14 in moving direction r2 in FIG. 2*b*. Between closing time t10 and closing time t12, lift characteristic 40 decreases from second needle lift value hN2 to first needle lift value hN1, which corresponds to the closing of nozzle needle 14 in moving direction r4 in FIG. 2*c*.

A closing period $d_{close}$ of nozzle needle 14 begins at closing time t10 of control valve 12 and ends at closing time t12 of nozzle needle 14. A first closing delay period $d_{c1}$ begins at activation ending time t7 and ends at closing time t12 of nozzle needle 14. Closing period $d_{close}$ of nozzle needle 14 and first closing delay period $d_{c1}$ are also generally referred to as a further time period.

A second closing delay period $d_{c2}$ begins at activation ending time t7 and ends at closing time t10 of control valve 12. An opening period $d_{open}$ of nozzle needle 14 begins at opening time t4 of nozzle needle 14 and ends at closing time t10 of control valve 12. An opening delay period $d_{o1}$ begins at activation starting time t0 and ends at opening time t4 of nozzle needle 14.

The opening of control valve 12 is associated with opening time t2. The opening of nozzle needle 14 is associated with opening time t4. The closing of control valve 12 is associated with closing time t10. The closing of nozzle needle 14 is associated with closing time t12.

Figure 4:
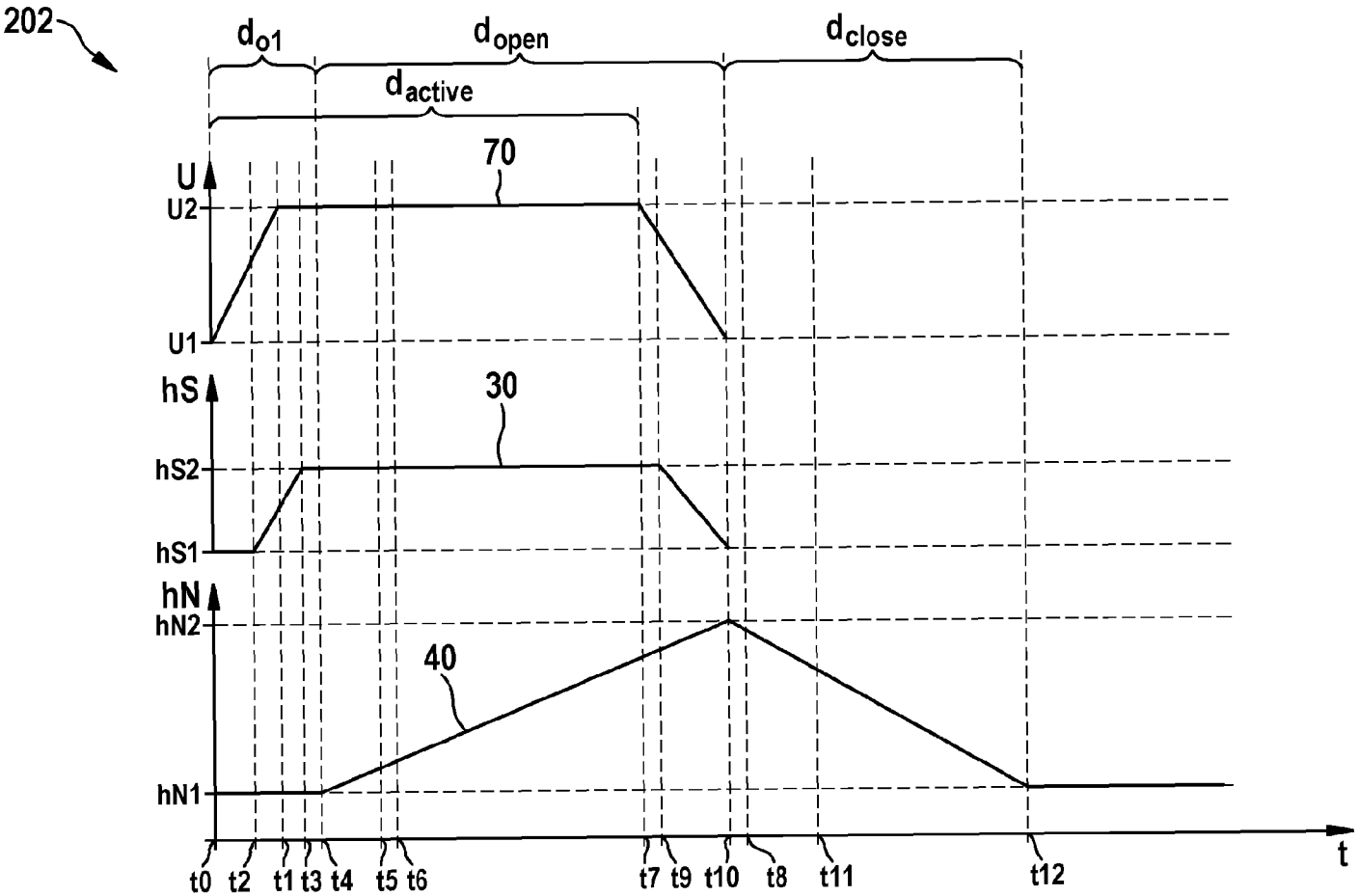
FIG. 4 shows a time-dependency diagram including a schematically illustrated voltage characteristic of the activation of a piezoelectric actuator, the schematically illustrated lift characteristic of the control valve, and the schematically illustrated lift characteristic of a nozzle needle.

FIG. 4 shows a time-dependency diagram 202 including a schematically illustrated voltage characteristic 70 of an activation of piezoelectric actuator 10 for opening piezoelectric actuator 10, the schematically illustrated lift characteristic 30 of control valve 12, and the schematically illustrated lift characteristic 40 of nozzle needle 14. Voltage characteristic 70 is assigned to a voltage axis U; a first voltage value U1 and a second voltage value U2 being plotted on voltage axis U. Second voltage value U2 is greater than first voltage value U1. Lift characteristic 30 of control valve 12 and lift characteristic 40 of nozzle needle 14 correspond to the characteristic curves from time-dependency diagram 200 of FIG. 3.

Starting from activation starting time t0, voltage characteristic 70 increases until time t1, from first voltage value U1 to second voltage value U2. Between time t1 and time t7, voltage characteristic 70 is at second voltage value U2. Between time t7 and time t8, voltage characteristic 70 decreases from second voltage value U2 to first voltage value U1. Activation starting time t0 and activation ending time t7 define activation period $d_{active}$. For an alternative definition of activation period $d_{active}$, time t1 may be selected, for example, instead of activation starting time t0. In the same manner, for an alternative definition of activation period $d_{active}$, time t8 may be selected instead of activation ending time t7.

Between activation starting time t0 and opening time t2 of control valve 12, lift characteristic 30 is at first valve lift value hS1, which corresponds to the closed state of control valve 12 in FIG. 2*a*. Between opening time t2 and time t3, lift characteristic 30 increases from first valve lift value hS1 to second valve lift value hS2, which corresponds to the opening of control valve 12 in moving direction r1 in FIG. 2*b*. Between time t9 and closing time t10, lift characteristic 30 falls from second valve lift value hS2 to first valve lift value hS1, which corresponds to the closing of control valve 12 in moving direction r3 in FIG. 2*c*. If lift characteristic 30 is at first valve lift value hS1, then control valve 12 is closed. If lift characteristic 30 is at second valve lift value hS2, then control valve 12 is open.

Figure 5:
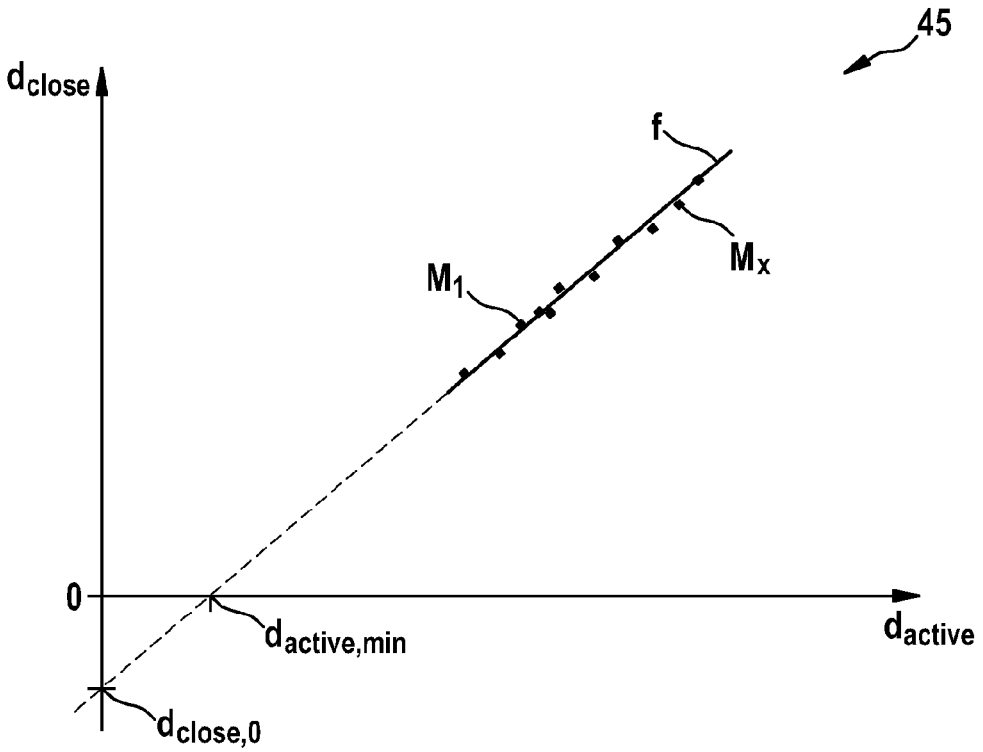
FIG. 5 shows a schematically illustrated activation-period/closing-period graph.

FIG. 5 shows a schematically illustrated activation-period/delay-period graph 45 having a $d_{active}$ axis for activation period $d_{active}$ and a $d_{close}$ axis for closing period $d_{close}$, which axis is perpendicular to the $d_{active}$ axis. Graph 45 is used for ascertaining, for an injector in a specimen-dependent manner, a smallest activation period $d_{active,min}$ that results in an injection.

Function f represents closing period $d_{close}$ of nozzle needle 14 versus activation period $d_{active}$ or activation period $d_{active}$ versus closing period $d_{close}$. A nearly linear relationship between closing period $d_{close}$ and activation period $d_{active}$ is assumed for function f. Therefore, function f is a substantially linear function. Function f is formed on the basis of a plurality of measuring points $M_1$, $M_x$; in each instance, a measuring point $M_1$, $M_x$ being made up of a value of closing period $d_{close}$ and a value of activation period $d_{active}$. Function f may be ascertained from the plurality of measuring points $M_1$, $M_x$, using, for example, the method of linear regression.

The $d_{active}$ axis and the $d_{close}$ axis intersect at the point $d_{close}=0$ and $d_{active}=0$. Function f intersects the $d_{active}$ axis at the shortest activation period $d_{active,min}$, during which nozzle needle 14 generally still opens or already opens and produces an injection. Function f intersects the $d_{close}$ axis at the $d_{close}$ axis intercept $d_{close,0}$. The linear form of function f may be represented by formula 1, where α corresponds to a definable factor.

$$f(d_{active})=\alpha\cdot(d_{active}-d_{active,min}) \quad (1)$$

The linear form of function f may also be represented in the form of formula 2, where m refers to the slope of a straight line and $d_{close,0}$ refers to the $d_{close}$ axis intercept.

$$f(d_{active})=m\cdot d_{active}+d_{close,0} \quad (2)$$

As an alternative to closing period $d_{close}$, first closing delay period $d_{c1}$ versus activation period $d_{active}$ or activation period $d_{active}$ versus first closing delay time $d_{c1}$ may be portrayed in accordance with another function and utilized accordingly. As an alternative to the linear function f shown in FIG. 5, other functions, for example, of a higher order and/or defined in sections, may also be used for representation between activation period $d_{active}$ and closing period $d_{close}$ or first closing delay period $d_{c1}$.

The determination of opening time t4 of nozzle needle 14 is explained in the following with reference to FIGS. 3 and 4. It is assumed that nozzle needle 14 opens at a substantially constant speed $v_{open}$ and closes at an essentially constant speed $v_{close}$. Speeds $v_{open}$ and $v_{close}$ fluctuate slightly as a function of rail pressure as a function of the specimen of the injector. If a constant rail pressure $P_{rail}$ is assumed, then there is a nearly linear relationship between closing period $d_{close}$ and opening period $d_{open}$, as shown in formula 3. Consequently, an equation according to formula 4 may be set up, where β constitutes an appropriate factor.

$$d_{open} \sim d_{close} \tag{3}$$

$$d_{open} = \beta \cdot d_{close} \tag{4}$$

According to FIG. 3, the relationship of formula 5 results from formula 4.

$$d_{o1} = d_{active} + d_{c2} - \beta \cdot d_{close} \tag{5}$$

If one assumes the case in which $d_{close} \rightarrow 0$, then the relationship according to formula 6 results, where an offset $d_{off}$ is added. Offset $d_{off}$ is a constant value, which, with regard to function f, compensates for the effect of the reduction in opening speed $v_{open}$ and the increase in closing speed $v_{close}$ in the case of short injections with a short closing period $d_{close}$ and a short opening period $d_{open}$. Alternatively, it is equally possible to set offset $d_{off}$ to zero.

$$d_{o1} = t4 - t0 = d_{active,min} + d_{c2}(d_{active,min}) + d_{off} \tag{6}$$

According to formula 6, opening delay period $d_{o1}$ of nozzle needle 14 results from additively combining shortest activation period $d_{active,min}$, second closing delay period $d_{c2}$ ($d_{active,min}$) and, optionally, offset $d_{off}$. Consequently, opening delay period $d_{o1}$ is ascertained as a function of the shortest activation period $d_{active,min}$. According to FIG. 3 and formula 6, opening delay period $d_{o1}$ begins at activation starting time t0 and ends at opening time t4 of nozzle needle 14.

Alternatively, in the graph shown in FIG. 5, the sum of activation period $d_{active}$ and closing delay period $d_{c2}$ may be plotted in place of activation period $d_{active}$. Function f for closing period $d_{close}$ is then alternatively ascertained according to formula 7, and formula 8 then applies to opening delay period $d_{o1}$. If closing delay period $d_{c2}$ is not known, then a calculation may be made using an assumed substitute value. Pairs of values $M_1$, $M_x$ are ascertained, which each assign a value of a $[d_{active}+d_{c2}]$ axis to a value of the $d_{close}$ axis. Pairs of values $M_1$, $M_x$ are made up, first of all, of the sum of activation period $d_{active}$ and second closing delay period $d_{c2}$, and secondly, of closing period $d_{close}$ or, alternatively, of first closing delay period $d_{c1}$. Using linear regression, function f is ascertained from above-mentioned pairs of values $M_1$, $M_x$. A smallest sum $[d_{active}+d_{c2}]_{min}$ is ascertained analogously to shortest activation period $d_{active,min}$ and is obtained from the intersection of alternatively ascertained function f with the $[d_{active}+d_{c2}]$ axis.

$$d_{close} = f(d_{active}+d_{c2}) = \gamma \cdot (d_{active}+d_{c2} - [d_{active}+d_{c2}]_{min}) \tag{7}$$

$$d_{o1} = [d_{active}+d_{c2}]_{min} + d_{off} \tag{8}$$

Using ascertained opening time t4 of nozzle needle 14 or opening delay period $d_{o1}$ according to formulas 6 and 8, opening period $d_{open}$ of nozzle needle 14 and, therefore, the overall period $d_{open}+d_{close}$, during which nozzle needle 14 is open, may be ascertained per opening cycle.

In addition, the relationship according to formula 9 is applicable.

$$\frac{dd_{close}}{dd_{active}} = -\frac{v_{open}}{v_{close}} \tag{9}$$

Figure 6:
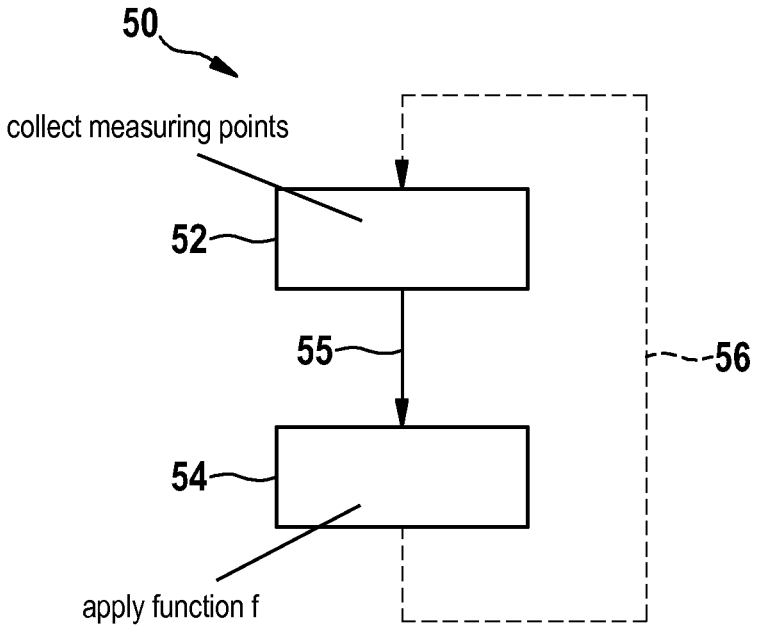
FIG. 6 shows a schematic flow chart.

FIG. 6 shows a schematic flow chart 50 having blocks 52 and 54. Block 52 is connected to subsequent block 54 by an arrow 55. An optional connection shown by arrow 56 leads from block 54 to block 52. Measuring points $M_1$, $M_x$ are collected in block 52. If a sufficient number of measuring points $M_1$, $M_x$ are available, then function f is ascertained in block 54. After block 54 is executed, function f is present, for example, in a formula according to formula 6 or 8. In accordance with arrow 56, further measuring points $M_1$, $M_x$ may be ascertained in block 52, in order to ascertain function f again or update function f.

Figure 7:
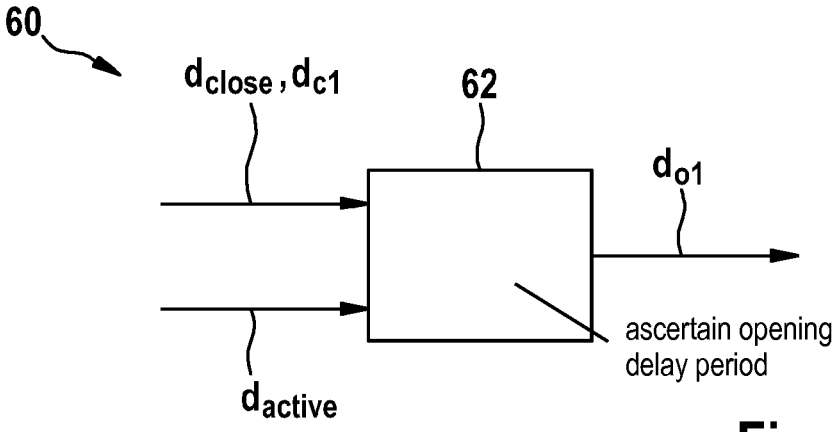
FIG. 7 shows a schematic block diagram.

FIG. 7 shows a schematic block diagram 60 including block 62. Activation period $d_{active}$, as well as closing period $d_{close}$ of nozzle needle 14 or first closing delay period $d_{c1}$, are supplied to block 62 after they are determined. As an option, closing delay period $d_{c2}$ or closing delay period $d_{c2}$ ($d_{active,min}$) may even be additionally supplied to block 62. Block 62 ascertains opening delay period $d_{o1}$ as a function of the supplied signals/values. As an alternative to supplying the shown signals/values, e.g., function f or an ascertainable time t0 through t12 may be supplied to block 62. Flow chart 50 may be part of block 62.

The example methods described above may be represented as a computer program for a digital computing element. The digital computing element is suitable for executing the above-described methods as a computer program. The internal combustion engine for, in particular, a motor vehicle, includes a control unit, which includes the digital computing element, in particular, a microprocessor. The control unit includes a storage medium, on which the computer program is stored.

What is claimed is:

1. A method for operating a fuel injection system of an internal combustion engine, the fuel injection system having an injector to meter fuel into a combustion chamber of the internal combustion engine, the injector having an actuator, a control valve and a nozzle needle, the method comprising:

supplying a voltage or a current to the actuator during an activation period, the control valve being set into a lifting motion by the actuator, and using a lifting motion of the control valve, the injector being opened and closed by the nozzle needle;

ascertaining a further time period, the further time period ending at a closing time of the nozzle needle;

ascertaining a function which links the activation period to the further time period;

ascertaining a shortest activation period, at which the nozzle needle still opens and produces an injection using the function; and ascertaining an opening delay period of the nozzle needle as a function of the shortest activation period.

2. The method as recited in claim 1, wherein the further time period is a closing period of the nozzle needle, which begins at a closing time of the control valve.

3. The method as recited in claim 1, wherein the further time period is a first closing delay period, which begins at an activation ending time of the activation of the actuator.

4. The method as recited in claim 3, wherein to ascertain the opening delay period of the nozzle needle, the shortest activation period is combined additively with a second closing delay period, and the second closing delay period begins at the activation ending time of the activation of the actuator and ends at the closing time of the control valve.

5. The method as recited in claim 4, wherein the second closing delay period is ascertained as a function of the shortest activation period.

6. The method as recited in claim 4, wherein the shortest activation period and the second closing delay period are additively combined for ascertaining the opening delay period.

7. The method as recited in claim 6, wherein pairs of values are ascertained, from a sum of the activation period and the second closing delay period, and from the closing period or the first closing delay period, and the function is ascertained from the pairs of values using linear regression.

8. The method as recited in claim 6, wherein a smallest sum is ascertained from the function in such a manner, that the smallest sum results for a value of the function that is equal to zero.

9. The method as recited in claim 3, wherein pairs of values are ascertained from the activation period and the closing period or the closing delay period, and the function is determined from the ascertained pairs of values using linear regression.

10. The method as recited in claim 1, wherein the shortest activation period is ascertained from the function in such a manner, that the shortest activation period results for a value of the function that is equal to zero.

11. A computer readable storage device storing program code for operating a fuel injection system, the fuel injection system having an injector to meter fuel into a combustion chamber of the internal combustion engine, the injector having an actuator, a control valve and a nozzle needle, the program code, when executed by a controller, causing the controller to perform:

supplying a voltage or a current to the actuator during an activation period, the control valve being set into a lifting motion by the actuator, and using a lifting motion of the control valve, the injector being opened and closed by the nozzle needle;

ascertaining a further time period, the further time period ending at a closing time of the nozzle needle;

ascertaining a function which links the activation period to the further time period;

ascertaining a shortest activation period, at which the nozzle needle still opens and produces an injection using the function; and ascertaining an opening delay period of the nozzle needle as a function of the shortest activation period.

12. A control unit for an internal combustion engine for a motor vehicle, the control unit being equipped with a microprocessor, the microprocessor configured to execute program code for operating a fuel injection system, the fuel injection system having an injector to meter fuel into a combustion chamber of the internal combustion engine, the injector having an actuator, a control valve and a nozzle needle, the program code, when executed by the microprocessor, causing the microprocessor to perform:

supplying a voltage or a current to the actuator during an activation period, the control valve being set into a lifting motion by the actuator, and using a lifting motion of the control valve, the injector being opened and closed by the nozzle needle;

ascertaining a further time period, the further time period ending at a closing time of the nozzle needle;

ascertaining a function which links the activation period to the further time period;

ascertaining a shortest activation period, at which the nozzle needle still opens and produces an injection using the function; and ascertaining an opening delay period of the nozzle needle as a function of the shortest activation period.

13. A storage medium for a control unit of an internal combustion engine of a motor vehicle, the storage medium storing program code for operating a fuel injection system, the fuel injection system having an injector to meter fuel into a combustion chamber of the internal combustion engine, the injector having an actuator, a control valve and a nozzle needle, the program code, when executed by the control unit, causing the control unit to perform:

supplying a voltage or a current to the actuator during an activation period, the control valve being set into a lifting motion by the actuator, and using a lifting motion of the control valve, the injector being opened and closed by the nozzle needle;

ascertaining a further time period, the further time period ending at a closing time of the nozzle needle;

ascertaining a function which links the activation period to the further time period;

ascertaining a shortest activation period, at which the nozzle needle still opens and produces an injection using the function; and ascertaining an opening delay period of the nozzle needle as a function of the shortest activation period.

* * * * *